US006022174A

United States Patent [19]

Husvik et al.

[11] Patent Number: 6,022,174

[45] Date of Patent: Feb. 8, 2000

[54] METHOD FOR INSTALLING A TENSION LEG PLATFORM

[75] Inventors: Jørgen Husvik, Høvik; Jan Muren, Borgen; Birger Natvig, Haslum; Paul Schamaun, Oslo; Horst Vogel, Rykkinn, all of Norway

[73] Assignee: Aker Engineering AS, Oslo, Norway

[21] Appl. No.: 08/973,705

[22] PCT Filed: Jun. 7, 1996

[86] PCT No.: PCT/NO96/00136

§ 371 Date: Dec. 8, 1997

§ 102(e) Date: Dec. 8, 1997

[87] PCT Pub. No.: WO96/40548

PCT Pub. Date: Dec. 19, 1996

[30] Foreign Application Priority Data

Jun. 7, 1995 [NO] Norway ..... 952246

[51] Int. Cl.[7] ..... E02D 7/00

[52] U.S. Cl. ..... 405/223.1; 405/195.1; 405/224.4

[58] Field of Search ..... 405/223.1, 224.1, 405/224.2, 224.3, 224.4, 224, 195.1, 204

[56] References Cited

U.S. PATENT DOCUMENTS 4,938,632 7/1990 Eie .
5,054,963 10/1991 Williamsson ..... 405/224
5,174,687 12/1992 Dunlop et al. .

FOREIGN PATENT DOCUMENTS 0045653 2/1982 WIPO .

*Primary Examiner*—David Bagnell
*Assistant Examiner*—Sunil Singh
*Attorney, Agent, or Firm*—Reed Smith Shaw & McClay LLP

[57] ABSTRACT

In a method for installing an offshore tension leg platform, a freely floating platform structure (7) is coupled to previously mounted tension legs (1) without the use of temporary motion compensating coupling mechanisms between the upper ends of the tension legs and the platform structure. Instead, permanently installed coupling elements (5) at the ends of the tension legs (1) are used and during the transition of the platform structure (7) from freely floating condition to moored condition by means of the tension legs (1), the coupling elements (5) are allowed to impact quite heavily against the corresponding connecting means (9) on the platform structure during its wave induced movements until it is held continuously by the tension legs. By making the tension legs (1) of exact length and arranging these in three groups which are coupled simultaneously to the platform structure, one can avoid any post-installation adjustment of the attachment points (5,9) of the tension legs (1) in the platform structure (7). In order to shorten the period during which impacts occur in the attachment points (5,9), the draft of the platform structure (7) can quickly be changed by releasing a larger weight (14) therefrom or pulling the platform to the side with respect to its equilibrium position during a transition phase.

20 Claims, 3 Drawing Sheets

METHOD FOR INSTALLING A TENSION LEG PLATFORM

The present invention relates to a method for installing an offshore tension leg platform, comprising the steps of bringing a freely floating platform structure to a temporary draft which is somewhat larger than normal draft in operating condition, bringing the platform structure into a predetermined position with respect to substantially vertically arranged tension legs, which in advance have been attached to one ore more foundations on the sea floor and which at their upper ends have been provided with a coupling element, guiding the tension legs in place with respect to the platform structure so that their coupling elements assume a position a distance above the corresponding connecting means on the platform structure, and causing a relative movement between the coupling elements and the platform structure in order to bring the coupling elements to attachment in the corresponding connecting means, whereupon further tensioning of the tension legs takes place by reducing the ballast of the platform structure.

Floating tension leg platforms (TLP) are tethered to the sea floor by means of vertical prestressed tension legs or tendons. The prestressing occurs as a result of the buoyancy being larger than the weight of the platform. Since the tendons have a substantial axial stiffness, the vertical movements of the platform due to waves are almost completely suppressed. The prestressing of the tendons are set so that the downwardly directed wave forces acting on the platform cannot make the tendons go slack. On the other hand, the tendons must possess sufficient strength to withstand the corresponding upwardly directed wave forces.

A substantial cost element is related to the use of temporary arrangements in connection with the attachment of the tendons and for moderating the transient dynamic behaviour of the platform going from freely floating to fixed tensioned condition. At the start of the installation, the platform will be floating freely, possibly with the exception of the interaction from tug boats and a catenary tethering system. In this phase, typical resonance periods will be 15–25 seconds for heave motion and 30–70 seconds for rolling and pitching. In the final installed condition, the stiffness of the tendons will reduce the heave/rolling/pitching resonance periods to 2–4 seconds. Under the external influence of direct wave forces, slowly varying second order wave forces and dynamics due to wind gusts, the restoring properties of the platform are gradually changed by the activation of the stiffness of the tendons. It is generally known that dynamic systems going from one dynamic steady-state condition to another, will do this through a transient dynamic transition. Such transient transitions may be violent also where the increasing restoring has a linear behaviour. For the installation of a TLP, this must normally be done in such a way that the increase in the restoring is not linear. It is known that the dynamic behaviour of non-linear systems may be worse than for linear systems and, furthermore, it is much more difficult to describe this behaviour through calculations. Up to now, this transient effect has been regarded as such a great problem for the tendons that substantial efforts have been spent in order to reduce its magnitude. This is clearly illustrated by the five TLP platforms built up to now and the same is done by the patent literature.

A method of the type mentioned in the introductory paragraph is known from U.S. Pat. No. 5,054,963. Here, four hydraulic cylinders having a stroke of 1,5 m are used for each tension leg in order to take up the transient movements.

The platform is deballasted until it is approaching its normal functioning level and concurrently the stroke of the pistons of the hydraulic cylinders is gradually reduced. When a corner of the platform finds itself in a wave trough the pistons for this corner are locked. This locking operation is repeated for the other corners. Thereafter the pistons are adjusted until the tension is the same in all the tension legs, and finally the tension legs are attached to the platform by means of a permanent threaded connection. The hydraulic cylinders and their complicated control system, which represent a very substantial investment, have now no longer any function.

The Heidrun platform, which is to be installed in the summer of 1995, is yet an example that great sums are used on mechanical equipment, the only purpose of which is to reduce the violence of the dynamic transient. In short, the method is to use a special form of coupling mechanism which rests on protrusions attached to the lower part of the column walls. The upper ends of the tendons are threaded, but in the period prior to installation, these may move freely inside the coupling mechanisms. On a given signal, when all is ready for installation, all coupling mechanisms are engaged simultaneously. In a system of falling wedges, which are threaded on the side facing the tendon, these act to lock themselves to the tendon on the side where the platform tries to move upwards. On the side where the platform moves downwards, on the other hand, the wedges will be pushed out of the threaded engagement so that the platform is free to move downwards. Since these engagements change from side to side, the platform is forced downwards, and the prestressing of the tendons are built up. Deballasting is done to reduce the length of this transient phase. Dynamically, this is an advantageous way of making use of the laws of nature.

The kinetic energy for rotation of the platform about horizontal axes is usually more important for the tendon forces than the kinetic energy due to the vertical movement. What is happening when the coupling mechanisms change between gripping when the platform tries to move upwards and letting it move freely when it moves downwards, is that the kinetic energy of the platform is converted to potential energy. In other words, the kinetic energy is used to force the platform downwards where it is held fast by the tension of the tendons. Since the kinetic energy is dissipated through the entire transient phase, this does only cause moderate forces in the coupling elements and the corresponding tendons.

Some of the coupling mechanisms that have been used up to now, represent elegant solutions in order to reduce the magnitude of the forces transmitted through a dynamic transient. The necessary equipment are especially made for the purpose and is only used in a short installation phase. The costs for this equipment increase substantially with increased loading. In order to limit their magnitude, restrictive weather limits are imposed for the installation. This leads to the temporary coupling mechanisms becoming the weakest link of the chain and much weaker than the tendon itself and the coupling unit at the bottom foundation.

The object of the present invention is to provide a method mentioned in the introductory paragraph, where the costs for the temporary equipment for handling the transient phase are at least substantial reduced.

This is obtained according to the invention by permitting the coupling elements, except in their end position, to move substantially without vertical constraint with respect to the connecting means during said relative movement, whereby a plurality of impacts may occur in said end position between the coupling elements and the corresponding connecting means as a result of the wave induced movements of the platform structure during said relative movement.

In other words, one has surprisingly found that the platform structure may be installed without the use of temporary coupling mechanisms. Even though the impacts occurring between the coupling elements and their connecting means on the platform structure may be quite violent in the installation phase, one has found that since both these and the tension legs themselves must be able to withstand the stresses that may occur through the entire operating phase, e.g. also during the so-called hundred-year wave situations, they will have sufficient strength to take up the impact forces. Through the course of an impact the tension leg will be stretched, but the potential energy cannot be stored in the tension leg as with the movable coupling units according to the prior art. What actually will happen, is that the energy will alternate between the kinetic energy of the platform structure and the potential energy of the tension legs. Due to viscous effects and friction, some of the kinetic energy will be dissipated. Concurrently, the intervals between consecutive impacts will be shorter all the time because the draft of the platform structure is concurrently reduced.

Further advantageous features of the invention are defined in the dependent claims.

For better understanding of the invention, it will be described in the form of exemplifying embodiments with reference to the appendant schematic drawings, wherein.

Figure 1:
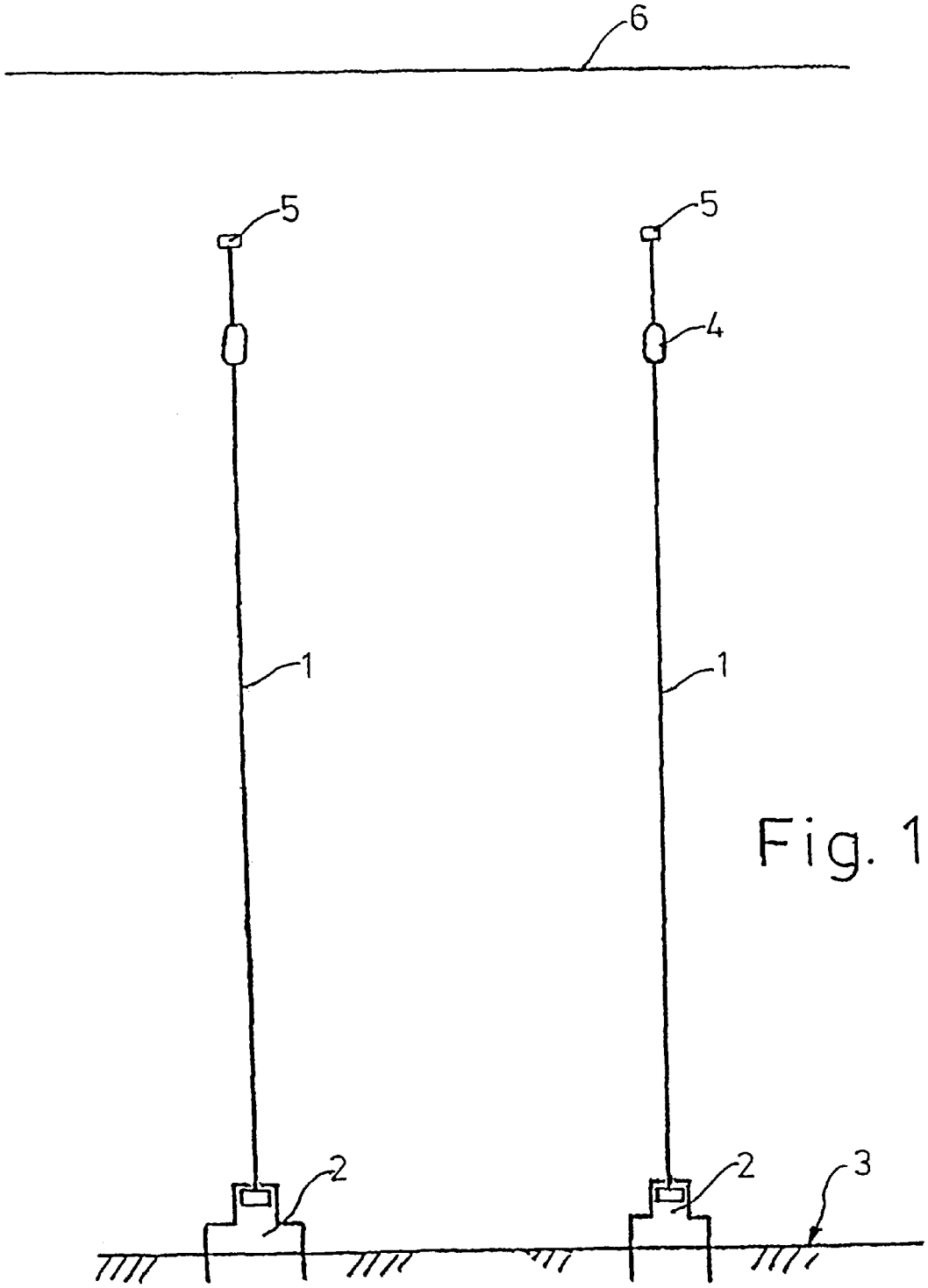
FIG. 1 is an elevation of two preinstalled tension legs.

In FIG. 1 two tension legs 1 are shown, each being attached to a foundation 2 on the sea floor 3. The tension legs, which may consist of steel pipes welded together, are held in upright position by means of buoyancy bodies 4, which may or may not be removed once the installation has been finished. At the top the tension legs are each provided with a coupling element 5, which e.g. may consist of a permanently installed sleeve. The preinstallation of the tension legs 1 on the foundations 2 may take place in several ways known per se, e.g. as shown in the previously mentioned U.S. Pat. No. 5,054,963. The length of each tension leg 1 has been determined with great accuracy, taking into consideration i.a. the actual location of the foundations 2, so that the positions of the coupling elements with respect to the water surface 6 are exactly as determined in advance.

Figure 2:
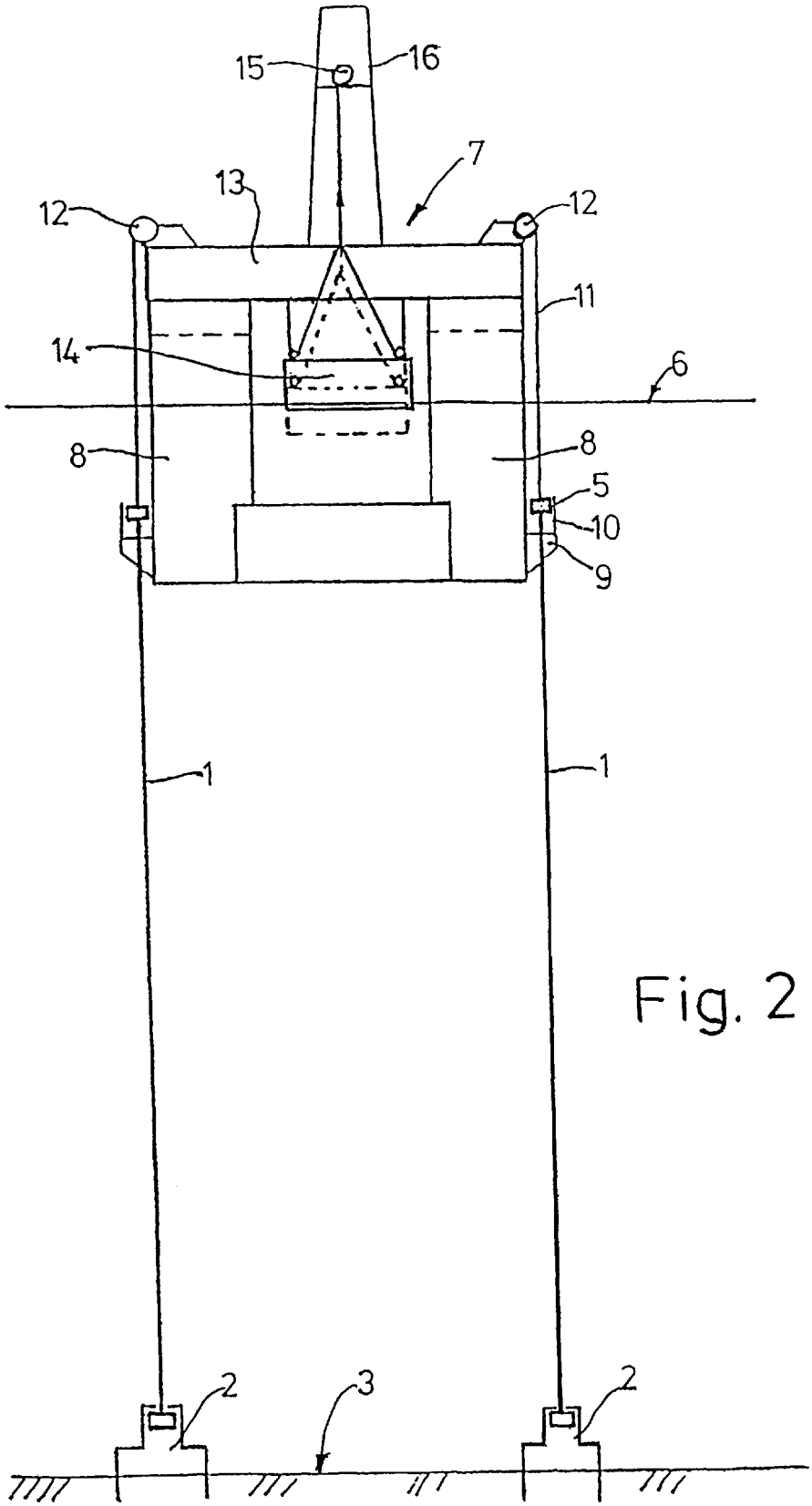
FIG. 2 shows the tension legs in FIG. 1 connected to a platform structure before its final installation.

FIG. 2 shows the tension legs 1 attached to a platform structure in an initial phase of the connection between the platform structure and the tension legs. Externally at the lower end of the columns 8 of the platform, connecting devices 9 for the coupling elements 5 of the tension legs are arranged. Each connecting device is provided with a vertical guide 10 for the corresponding coupling element 5. Furthermore, the connecting device has a vertical slot having a width which is somewhat larger than the diameter of the tension leg but which is narrower than the diameter of the coupling element 5. This slot permits lateral introduction of the tension leg in the connecting device to the position shown in FIG. 2, the condition being that the introduction takes place at a somewhat larger draft of the platform structure 7 so that the coupling elements 5 may pass over the guide 10 during the lateral movement.

FIG. 2 also shows that a cable 11 is attached to each coupling element 5, the cable being connected to a winch 12 on the deck 13 of the platform structure. The winch 12 is used to pull the tension leg 1 in place with respect to the connecting device 9 and it may also be used to damp the slowly varying movements of the platform structure during the final coupling phase.

It will be understood that the introduction of the tension legs and coupling elements 5 in the connecting devices 9 will have to take place at a somewhat larger draft of the platform 7 than the one shown in FIG. 2. In this connection the platform structure is generally floating freely and may have quite substantial slowly varying movements with the same period as the natural stamping period. These slowly varying movements will have superimposed smaller movements with the same period as the waves. By tensioning the cables 11 and controlling the winches 12 in a suitable manner, e.g. as explained in the following, the slowly varying movements may be damped almost entirely, and the remaining vertical movements having the same period as the waves will then typically only be 5–10% of the wave height. In this situation the draft of the platform structure may be reduced by means of the ballast pumps so that the coupling elements 5 assume a position as shown in FIG. 2, with a typical average distance to the connecting devices 9 of e.g. 0,5 m. This will be the starting point for the final connection, which advantageously can take place by a relatively quick reduction of the draft of the platform structure 7.

Such a reduction can be envisioned obtained in different ways or combinations of such. A possible way is to use a weight 14, e.g. a barge or similar floating body, which is suspended under the deck 13 of the platform structure as shown in FIG. 2. Here, the hoisting apparatus 15 in the drilling tower 16 of the platform structure is used, via a tackle arrangement, to lift the barge 14 partly out of the water, thereby loading the platform structure with a load of e.g. 3000 tons. By releasing the load so that the barge moves to the position shown in broken lines in FIG. 2, the initial average clearance of 0,5 m between the coupling elements 5 and the corresponding connecting devices 9 may be taken up relatively quickly, but will lead to relatively strong impacts therebetween. However, calculations have shown that the impact force nevertheless will stay within the normal capacity of the tension legs. One reason for this is that tension leg platforms generally are used at large ocean depths. Due to the correspondingly long length of the tension legs, these will have a certain flexibility permitting them to absorb the impact forces. However, should the impact forces become greater than desirable, they may be reduced by causing a slower raising of the platform structure, e.g. by letting this take place by emptying of ballast water only, but in such a case one has to accept in return that the impacts between the coupling elements and connecting devices take place over a longer period.

Another method for obtaining quick raising of the platform structure is by emptying ballast from special ballast tanks situated above the water line level.

Whether or not one employs a quick weight reduction, ballast water will be pumped out during the connecting phase and will continue until one has obtained the necessary prestressing of the tension legs 1 to prevent these from becoming slack.

Figure 3:
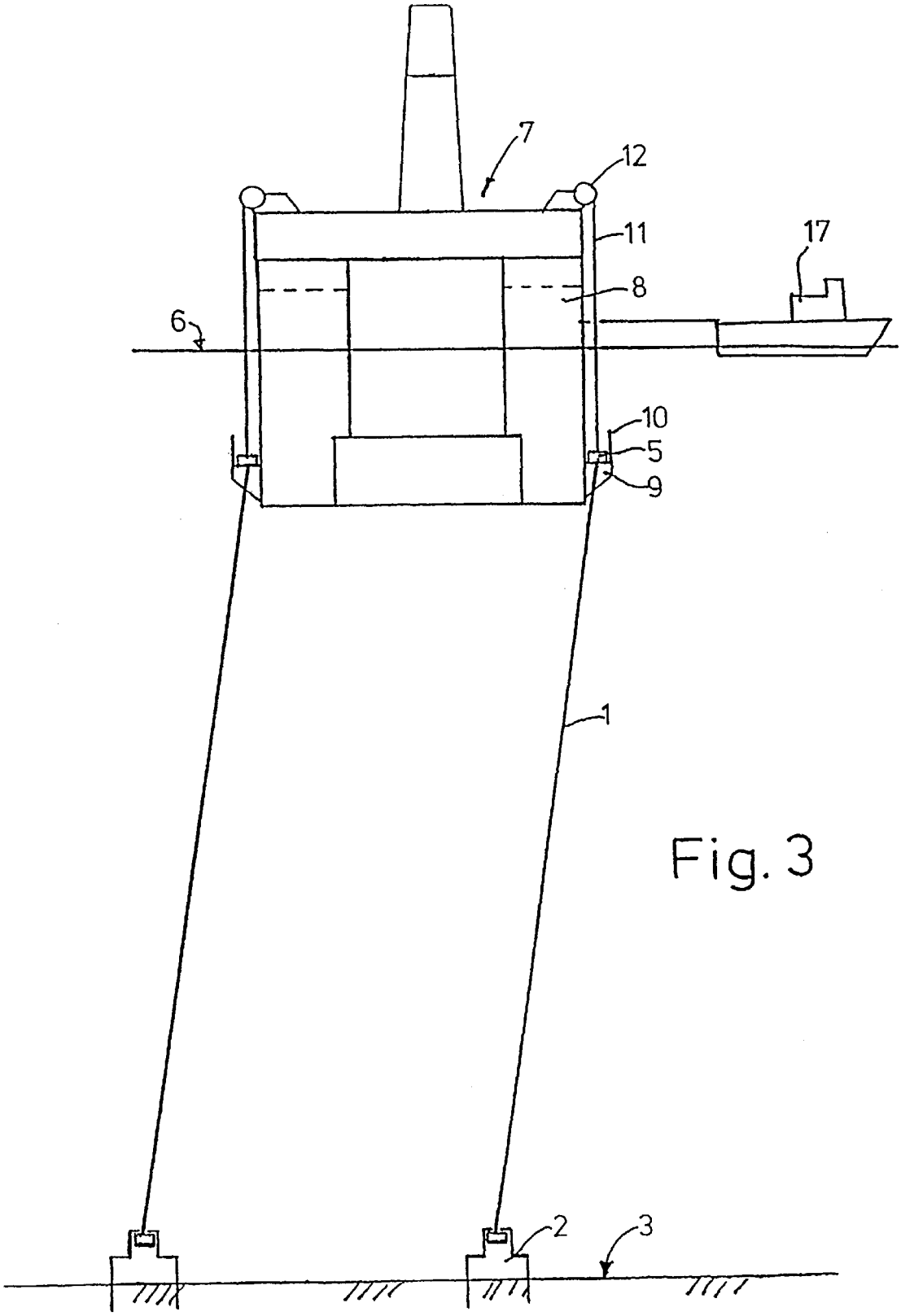
FIG. 3 shows a variant of FIG. 2.

FIG. 3 illustrates an alternative method for relatively quickly taking up the clearance shown in FIG. 2 between the coupling elements 5 and connecting devices 9. Here, the platform structure 7 is simply pulled to the side of its position vertically above the foundations 2 on the sea floor, e.g. by means of a tug boat 17, and due to the tilting position of the tension legs 1, the clearance in this case may be taken up without changing the draft of the platform structure.

While the tug boat 17 tries to hold the platform structure 7 in the position shown, ballast water is pumped out until the tension legs have obtained the necessary prestressing, which concurrently leads to the platform structure being drawn back in place over the foundations. It will be noted that this method can be performed without providing the platform structure with special equipment of any kind and that it will give less forceful impacts due to the lower stiffness in the vertical direction caused by the tilting position of the tension legs.

If the expected impact force at the first time of contact between the coupling elements 5 and the connecting devices 9 should be higher than desirable, e.g. because the tension legs are unusually short or stiff, or the connection has to take place under especially disadvantageous weather conditions, the impact force may be reduced by arranging an energy dissipating device between the coupling element and the corresponding connecting device. This energy dissipating device may advantageously be of the plastically deformable type.

It will be understood that when only one tension leg is shown for each platform column, this has been done for the sake of clarity. Usually, for each platform column there will be a group of tension legs, normally three or more, and the platform structure will usually have three or four columns. A platform structure having three columns will be statically determined and can make use of the present invention without the need for any readjustment possibility of the positions of the coupling elements in the connecting devices if the lengths of the tension legs are determined and made sufficiently accurate. The method may also be used for platform structures having four or more columns, but with the modification that the initial installation with tension legs without adjustment possibilities takes place for three of the columns of the platform structure, such that one also in this case initially has a statically determined structure. Thereupon the tendons for the one or more remaining columns are tensioned and attached in some practical way, e.g. by means of hydraulic jacks or mechanical wedges.

It has been mentioned above that the slowly varying movements of the platform structure may be damped by tightening the cables 11 and controlling the winches 12 in a suitable manner. An example of such controlling is known from the previously mentioned U.S. Pat. No. 5,054,963. Here, the winches are provided with passive heave compensation, permitting the lines to be provided with a constant tensioning force of about 30 tons. Ideally speaking, this would have no influence on the movements of the platform structure, but due to hysteresis-like effects in the hydraulic system and the cable transmission, a certain damping of the movements may nevertheless take place.

A different and more effective way is to prestress the cables to a given value and lock the winches, however such that these will yield if the cable tension supersedes a permitted limit. Furthermore, the winches may heave in if slack should occur in the cables. In this way the roll/pitch stiffness increases, this stiffness being initially very small due to low metacentre height. Calculations and model tests have shown that this is a predictable, safe and very effective way of reducing rotational movements of the platform structure before the final connection.

A further method is to control the winches such that these, e.g. by means of braking forces, provides a more or less constant resistance against pulling out of the cable, while slack in the cable is heaved in without noticeable force. Thus, the winches will bleed energy out of the platform structure when it moves upwards but will not add energy under its subsequent downward movement.

We claim:

1. A method for installing an offshore tension leg platform, comprising the steps of bringing a freely floating platform structure (7) to a temporary draft which is somewhat larger than normal draft in operating condition, bringing the platform structure (7) into a predetermined position with respect to substantially vertically arranged tension legs (1), which in advance have been attached to one or more foundations (2) on the sea floor (3) and which at their upper ends have been provided with a coupling element, guiding the tension legs (1) in place with respect to the platform structure (7) so that their coupling elements (5) assume a position a distance above the corresponding connection means (9) on the platform structure (7), and causing a relative movement between the coupling elements (5) and the platform structure (7) in order to bring the coupling elements (5) to rest against a seat in the corresponding connecting means (9), whereupon further tensioning of the tension legs (1) takes place by reducing the ballast of the platform structure (7), characterized in that the coupling elements (5), except in their end position, are permitted to move substantially without vertical constraint with respect to the connecting means (9) during a final stage of said relative movement and to impact in said end position against the seat in the corresponding connecting means (9).

2. A method according to claim 1, characterized in that the coupling elements (5) are permitted to move substantially freely with respect to the platform structure (7) during said relative movement.

3. A method according to claim 2, characterized in that slowly varying movements of the platform structure with a period substantially corresponding to its natural stamping period are dampened by applying a varying vertical force between the top of the coupling elements (5) and the platform structure (7).

4. A method according to claim 2, characterized in that said relative movement is caused at least in part by pulling the platform structure (7) laterally away from said predetermined position with respect to the tension legs (1).

5. A method according to claim 2, characterized in that said relative movement is caused at least in part by releasing a weight (14) which in advance has been suspended in the platform structure (7).

6. A method according to claim 5, characterized in that a floating body is used for said weight.

7. A method according to claim 5, characterized in that said weight (14) is suspended in advance by means of a hoisting apparatus (15) in a drilling tower (16) on the platform structure (7).

8. A method according to claim 2, characterized in that said relative movement is caused at least in part by releasing water from ballast tanks placed in the platform structure (7) above the water line level (6).

9. A method according to claim 2, characterized in that it is carried out simultaneously for the tension legs (1) in three corners of the platform structure (7).

10. A method according to claim 1, characterized in that slowly varying movements of the platform structure with a period substantially corresponding to its natural stamping period are dampened by applying a varying vertical force between the top of the coupling elements (5) and the platform structure (7).

11. A method according to claim 10, characterized in that said relative movement is caused at least in part by pulling the platform structure (7) laterally away from said predetermined position with respect to the tension legs (1).

12. A method according to claim 10, characterized in that said relative movement is caused at least in part by releasing a weight (14) which in advance has been suspended in the platform structure (7).

13. A method according to claim 1, characterized in that said relative movement is caused at least in part by pulling the platform structure (7) laterally away from said predetermined position with respect to the tension legs (1).

14. A method according to claim 1, characterized in that said relative movement is caused at least in part by releasing a weight (14) which in advance has been suspended in the platform structure (7).

15. A method according to claim 14, characterized in that a floating body is used for said weight.

16. A method according to claim 15, characterized in that the floating body is a barge (14).

17. A method according to claim 14, characterized in that said weight (14) is suspended in advance by means of a hoisting apparatus (15) in a drilling tower (16) on the platform structure (7).

18. A method according to claim 1, characterized in that said relative movement is caused at least in part by releasing water from ballast tank placed in the platform structure (7) above the water line level (6).

19. A method according to claim 1, characterized in that it is carried out simultaneously for the tension legs (1) in three corners of the platform structure (7).

20. A method according to claim 1, characterized in that the coupling elements (5) and corresponding connecting means (9) are located below the sea surface.

* * * * *